US007651302B2

(12) United States Patent
Mullins et al.

(10) Patent No.: US 7,651,302 B2
(45) Date of Patent: Jan. 26, 2010

(54) METHOD OF ENHANCED END BEARING CAPACITY VIA POST CONSTRUCTION PRELOAD/RELOAD

(75) Inventors: Gray Mullins, Bradenton, FL (US); Danny Winters, Tampa, FL (US); Mike Stokes, Plant City, FL (US); Christopher L. Lewis, Riverview, FL (US)

(73) Assignee: University of South Florida, Tampa, FL (US)

( * ) Notice: Subject to any disclaimer, the term of this patent is extended or adjusted under 35 U.S.C. 154(b) by 237 days.

(21) Appl. No.: 11/676,410

(22) Filed: Feb. 19, 2007

(65) Prior Publication Data

US 2007/0237587 A1 Oct. 11, 2007

Related U.S. Application Data

(60) Provisional application No. 60/744,447, filed on Apr. 7, 2006.

(51) Int. Cl.
*E02D 3/12* (2006.01)

(52) U.S. Cl. ..... 405/266; 405/237

(58) Field of Classification Search ..... 405/263–266, 405/267, 271, 237, 238
See application file for complete search history.

(56) References Cited

U.S. PATENT DOCUMENTS 3,742,717 A * 7/1973 Wey ..... 405/238
3,783,624 A * 1/1974 Nakade et al. ..... 405/264
4,971,480 A * 11/1990 Nakanishi ..... 405/269
6,371,698 B1 4/2002 Beck, III et al.
6,942,429 B1 * 9/2005 Beck et al. ..... 405/236

OTHER PUBLICATIONS

Dapp, S., and Mullins, G. 2002. "Pressure grouting drilled shaft tips: Full scale research investigation for silty and shelly sands." Geotechnical Special Publication. No. 116. M.W. O'Neill and F.C. Townsend, eds., col. 1 ASCE. Reston, Va. pp. 335-350.

Flemming, W.G.K. 1993. "The improvement of pile performance by base grouting." Proc. Institution of Civil Engineers. London.

(Continued)

*Primary Examiner*—John Kreck
(74) *Attorney, Agent, or Firm*—Ronald E. Smith; Smith & Hopen, P.A.

(57) ABSTRACT

A method for increasing stiffness of bearing strata formed of soil, rock or other geomaterial includes the steps of injecting non-hardening pre-compression fluids, in the form of viscous non-hardening slurries that are pressurized beneath a foundation tip for extended periods of time, into the bearing strata to cause pre-compression of the bearing strata. This enhances end bearing capacity in poorly draining soils by providing more time to squeeze water from voids in the poorly draining soils. The bearing strata may also be mechanically pre-compressed. The non-hardening pre-compression fluids may be exchanged with grout to fill a void formed by cavity expansion and previously occupied by the non-hardening, pre-compression fluid. This grout is cured without external additional pressure. Grout may be used in lieu of non hardening pre-compression fluids to affect end bearing enhancement provided that external additional pressure is not applied to the grout while it cures.

9 Claims, 9 Drawing Sheets

OTHER PUBLICATIONS

Gouvenot, D., and Gabiax, F.D. 1975. "A new foundation technique using piles sealed by cement grout under high pressure." Proc. 7th Annual Offshore Technical Conf.

Mojabe, M.S., and Duffin, M.J. 1991. "Large diameter. rock socket, base grouted piles in bristol." Proc. 4th Int. Conf. on Piling and Deep Foundations. Stresa, Italy.

Mullins, G. Dapp, S., and Lai, P. 2000. "Pressure-grouting drilled shaft tips in sand." New technological and design developments in deep foundations. N.D. Dennis, R. Castelli, and M.W. O'Neill. eds. ASCE. Reston, Va.

O,Neill M.W. 2002. "Side resistance in piles and drilled shafts." J. Geotech. Geoenviron. Eng. 127. pp. 3-16.

Piccione, M., Carletti, G., and Diamanti, L. 1984. "The piled foundations of the Al Gazira Hotel in Cairo." Proc. Int. Conf. on Advances in Piling and Ground Treatment for Foundations. Institution of Civil Engineers. London.

Santosuossa, M., Rizzi, G., and Diamanti, L. 1991. "Construction of pile foundationof the 'postal citadel' in the direction center in Naples." Proc. 4th Int. Conf. on Piling and Deep Foundations. Stresa, Italy.

Troughton, V.M. and Platis, A. 1989. "The effects of changes in effective stress on a base grouted pile in sand." Proc. Int. Conf.. on Piling and Deep Foundations. London.

Bruce, D.A. 1986. "Enhancing the performance of large diameter piles by grouting." Ground Engineering. vol. 19. pp. 9-15.

Bruce, D.A., Nufer, P.J., and Triplett, P.A. 1995. "Enhancement of caisson capacity by microfine cement grouting- A recent case history." Verification of geotechnical grouting. M.J. Byle and Roy H. Borden. eds. ASCE. New York. pp. 142-152.

Mullins, G. 1999. "Interviews with engineers during load testing on the Taipei Financial Center." Taipei, Taiwan.

* cited by examiner

METHOD OF ENHANCED END BEARING CAPACITY VIA POST CONSTRUCTION PRELOAD/RELOAD

CROSS REFERENCE TO RELATED APPLICATIONS

This disclosure claims priority to co-pending provisional application No. 60/77,447, filed by the present inventors on Apr. 7, 2006, entitled: "End bearing Enhancement via Post Construction Preload-Reload." Said provisional application is hereby incorporated by reference into this disclosure.

BACKGROUND OF THE INVENTION

1. Field of the Invention

This invention is related, generally, to drilled shafts. More particularly, it relates to a method that enhances the foundations of structures.

2. Description of the Prior Art

Drilled shafts are large-diameter cast-in-place concrete structures that develop enormous axial capacity to resist heavy loads from tall buildings, bridges, and the like. They develop such capacity from a combination of side shear resistance (sometimes called skin friction) and end bearing capacity (also called tip capacity). However, the end bearing capacity is rarely fully utilized due to the large displacement required to develop it.

What is needed, then, is a method that reduces the amount of displacement required to develop end bearing capacity, thereby increasing the usable overall capacity.

One prior art method (Beck et al.) provides similar improvements, but differs from the novel method in four points: (1) The Beck et al. method results in an end bearing that is about twice that of an unimproved foundation; (2) It uses pressurized grout that cures under pressure in the base of the foundation; (3) It may unwittingly leave the foundation at the brink of failure; and (4) It discloses the use of grout and no other material to perform end bearing improvement.

Thus there is a need for a method where the end bearing capacity is not limited to twice the capacity of an unimproved foundation, where grout subjected to external additional pressure that is locked-in while it cures is not used in the base of the foundation, that does not place the foundation in danger of failure, and that does not employ only grout to perform end bearing enhancement.

In the prior art, end bearing enhancement from pressure grouting with hardening fluids is limited to free-draining soils that are compressible in the time frame associated with the chemical reaction of hardening grout.

There is a need, therefore, for a method that enables enhancement of end bearing capacity in poorly draining soils by allowing more time to squeeze water from voids in such soil.

Studies have shown that by merely preloading and unloading a foundation, the resulting stiffness when reloaded is dramatically improved (Mullins, et al. 1999, 2000, 2004, 2006). Stiffness is the ratio of applied load to resulting displacement. As such, foundation capacities are influenced by the act of loading and reloading as well as the degree to which it is loaded. Methods that cause preloading are therefore considered desirable. However, in the case of post-grouting deep foundations (injecting high pressure grout beneath the tip), studies (Frederick, 2001, Mullins, 2004) have further shown that similar end bearing enhancement is obtained when grout cures with additional external pressure is locked-in or when cured under at-rest hydrostatic pressure. Locked-in pressure is achieved by closing a permanent in-line valve at the top of the shaft once the maximum or desired design pressure is obtained. These two methods function differently, but the resultant improvement is about the same when the shaft is tipped in free draining soils.

However, when tipped in rock or other fracturing bearing strata, the net result of the two methods is quite different; maintaining additional pressure while curing can lead to catastrophic failure. Thus, the performance enhancement of pressure grouted foundations that utilizes only the increased stiffness associated with preloading and subsequently reloading a foundation element is considered to be safer.

There is a need, therefore, for a method that improves the end bearing capacity of deep foundations without using grout and that cures while subjected to locked-in external/additional pressure.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a safe methodology enabling the development of drilled shafts having improved end bearing capacity and providing means for enhancing end bearing capacity is now met by a new, useful, and nonobvious invention.

More particularly, the novel method eliminates the need to cure grout while maintaining a locked-in external additional pressure.

These and other objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

DETAILED DESCRIPTION OF THE PREFERRED EMBODIMENT

Figure 1A:
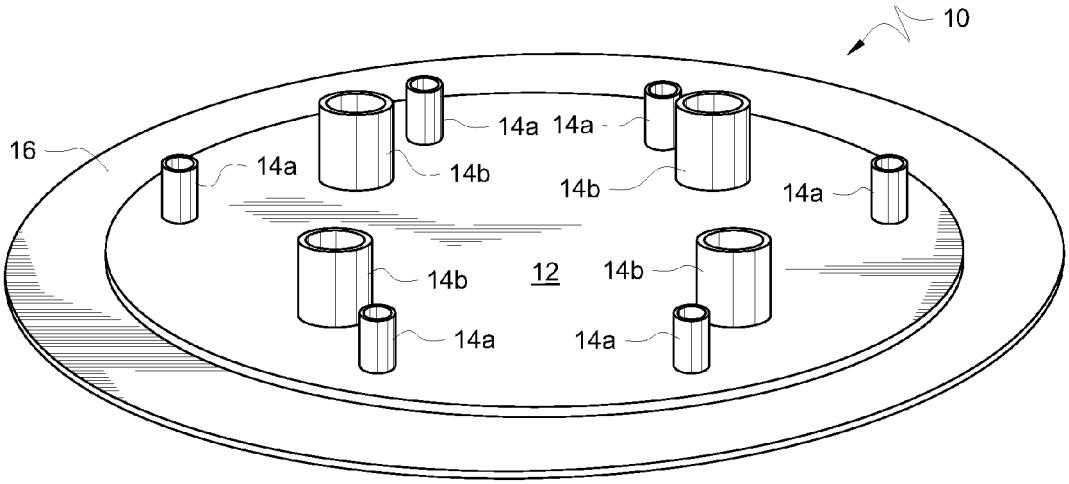
FIG. 1A is a perspective view of a steel plate with tubing connections being placed on a thin sheet of rubber.

The novel method uses hardening or non-hardening pre-compression fluids or mechanical means to pre-compress soil, rock, or other geomaterial, thereby increasing the stiffness of the bearing strata. The novel method does not require grout to be pressurized during the curing. It provides end bearing improvement up to ten times greater than the end bearing of an unimproved foundation. In some applications, the end bearing improvement may be more than ten (10) times greater than the end bearing of an unimproved foundation.

The relatively high range of improvement is best explained by the density state and soil type, coupled with the amount of available shaft side shear. Looser, low density end bearing strata show the highest improvement potential and high density soil shows lower improvement potential.

The novel method includes the step of exchanging a non-hardening pre-compression fluid with grout to fill the void created by and previously occupied by the pre-compression fluid.

In the novel method, grout is not cured while an applied pressure is locked in. This is particularly important when the pressure grouting is applied in brittle strata such as rock socketed shafts. In such cases, locking the applied grout pressure in forces the side shear to react with a downward force that balances the upward grout pressure. Upon subsequent structural loading, all loads are transferred directly to the tip until sufficient displacement is experienced to reverse the side shear force direction. If the end bearing strata cannot tolerate the additional load or a brittle fracture occurs beneath the tip, all load is quickly transferred to the side shear whereby it will be forced to solely support the structural load. Under these conditions, relying on additional strain tolerance could be catastrophic and may cause the two capacity components (side shear and end bearing) to act independently instead of in concert. The novel end bearing enhancement method allows both the side shear and end bearing to develop simultaneously without stress/strain reversals.

End bearing enhancement from pressure grouting with hardening fluids, in accordance with prior art methods as noted above, is limited to free-draining soils that are compressible in the time frame associated with the chemical reaction of hardening grout. The novel method, however, optionally employs viscous non-hardening slurries that are pressurized beneath the foundation tip for extended periods of time. This provides a mechanism by which the end bearing capacity in poorly draining soils (e.g., silts and clayey soils) is enhanced by providing more time to squeeze water from its voids. Upon achieving a suitable pressure (preloading), the void created by the associated cavity expansion is filled with hardening grout which cures without external additional pressure.

The novel procedure for enhancing end bearing capacity includes post construction preload and reload. Enhancing end bearing of drilled shafts via preloading has only a minimal effect on the overall construction of the foundation and is similar in the level of complexity and effort to that of the construction of an un-enhanced shaft. The process involves several steps starting with a suitable design or shaft length and diameter that can accommodate the anticipated structural loads, installing a pressure cell and required tubing in a reinforcing cage of the drilled shaft, constructing the shaft using normal construction practices, and then enhancing the end bearing to a level dependent upon the amount of pressure applied.

The design of any foundation involves balancing the resisting capacity of a foundation with the required load carrying capacity which is determined by the size, weight, and nature of the structure it supports. For end bearing enhanced drilled shafts, the amount of enhancement is proportional to the pre-compression pressure applied to the bearing strata beneath the foundation. Generally, this pressure is directly related to the amount of side shear and structural weight that can be developed before the foundation is pushed out of the ground by the pre-compression fluid at its base. As a result, deeper, longer shafts and shafts with higher unit side shear can generate more fluid pressure at the base and therefore provide a higher degree of end bearing enhancement. An estimated overall shaft capacity can be provided by computing the side shear and the potential for pre-compression pressure. A thorough discussion of this methodology can be found in Mullins, et al., 2006.

Prior to shaft excavation, steel reinforcing cages are designed based on the anticipated loads for that foundation. The cages are assembled on site. The fluid tubes and pressure cell that provide a pathway to the end bearing region of the shaft are affixed to the cages. The tubes are generally between 0.5 and 1.0 inches in inner diameter, but can be any size sufficient to enable pre-compression fluid to flow freely and which can withstand the anticipated pressure. One tube is required but a plurality of tubes is preferred to ensure that the pre-compression fluid can be pumped to its destination and then returned via a second or third tube, which return indicates good fluid distribution at the base.

Although numerous configurations can be used, the pressure cell is preferably provided in the form of a flat plate sized to fit the reinforcing cage. The pressure cell is either wrapped in a membrane on its bottom face or is in some other way isolated from the shaft concrete thereby providing a predefined surface over which the pre-compression fluid can act. Accommodation should be made through the plate to: 1) Couple the fluid lines/tubes to the plate; and 2) Provide a pathway for the pre-compression fluid to the bearing strata beneath the shaft. Dependent upon the bearing strata type, the bearing strata may be: 1) Isolated from the pre-compression fluid such that no fluid intrusion occurs; 2) Confined within a bladder so that no fluid intrusion occurs; or 3) Open to permit the pre-compression fluid to directly contact the bearing strata. These cells can be conventional and are not specific to the novel method. An unobstructed access to the area beneath the shaft on which the enhancement method can be applied is required.

A simple pressure cell 10 with a rubber membrane may be used to provide an unobstructed surface on which to apply the pre-compression fluid pressure. FIG. 1A depicts a flat, circular steel plate 12 with connections 14*a* and 14*b* secured thereto. Connections 14*a* are adapted to engage rebars that collectively form a reinforcing cage. Said connections 14*a* are therefore mounted about the periphery of steel plate 12. Larger diameter tubing connections 14*b* are adapted to engage fluid tubes. Steel plate 12 is positioned atop a thin sheet of rubber 16.

Figure 1B:
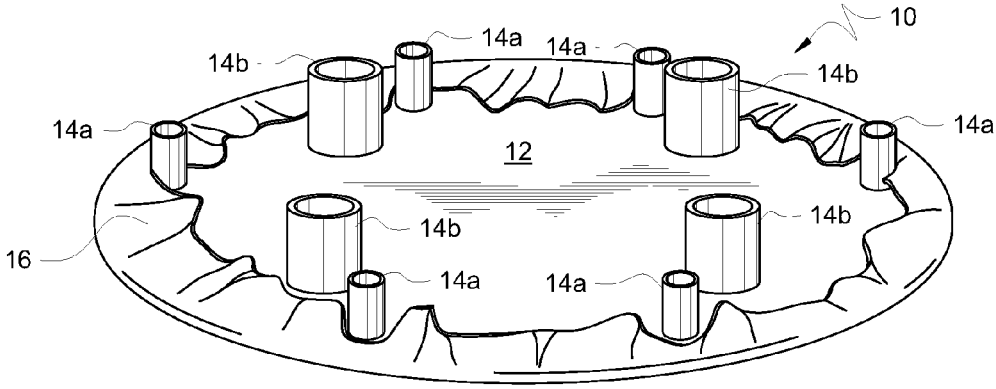
FIG. 1B is a perspective view of the structure depicted in FIG. 1 after the membrane has been stretched over it and glued to the upper surface.

FIG. 1B depicts pressure cell 10 after rubber membrane 16 has been stretched over it and glued to the top surface of said steel plate 12.

Figure 2A:
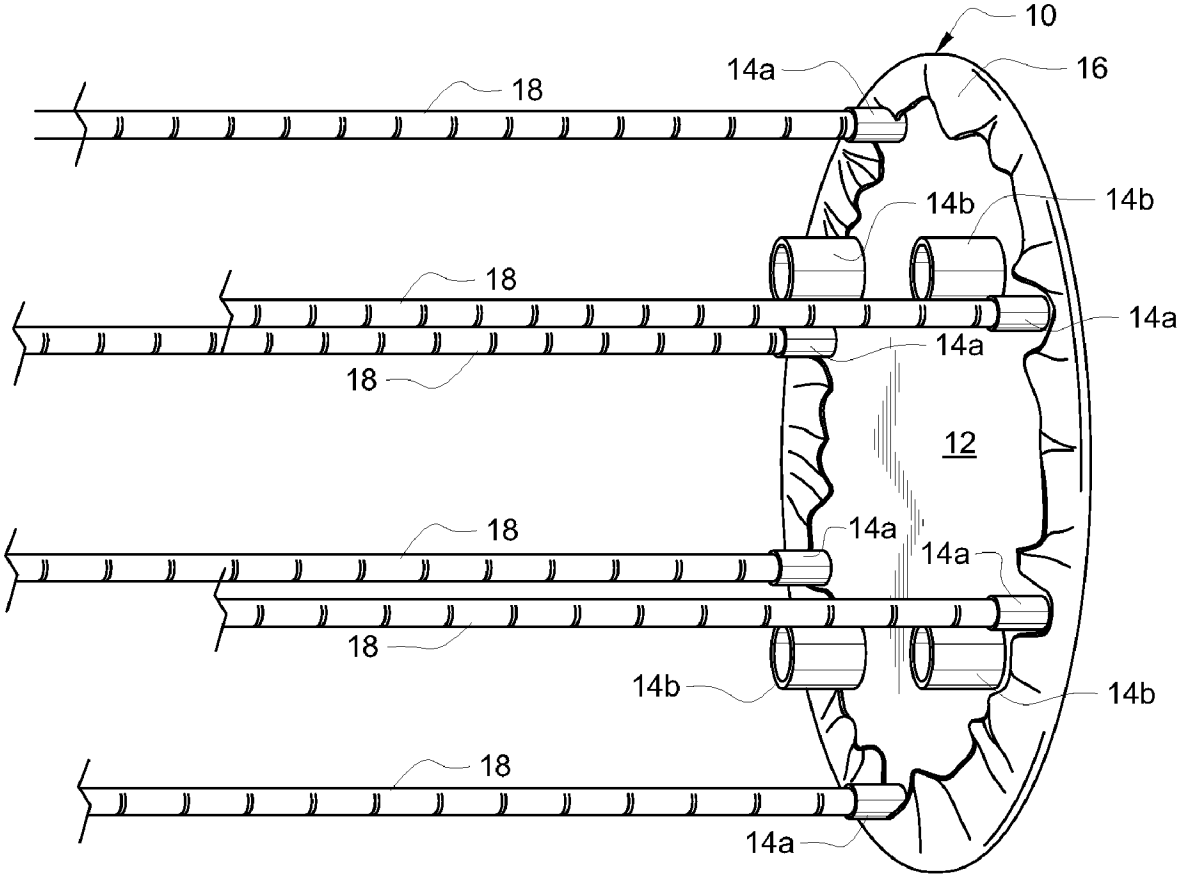
FIG. 2A is a perspective view of a pressure cell attached to the bottom of a reinforcing cage.

Pressure cell 10 is attached to the base of a reinforcing cage as depicted in FIG. 2A. The rebars that collectively form the reinforcing cage are collectively denoted 18 and the respective free ends of said rebars are received within and secured to their respective connections 14*a*.

Figure 2B:
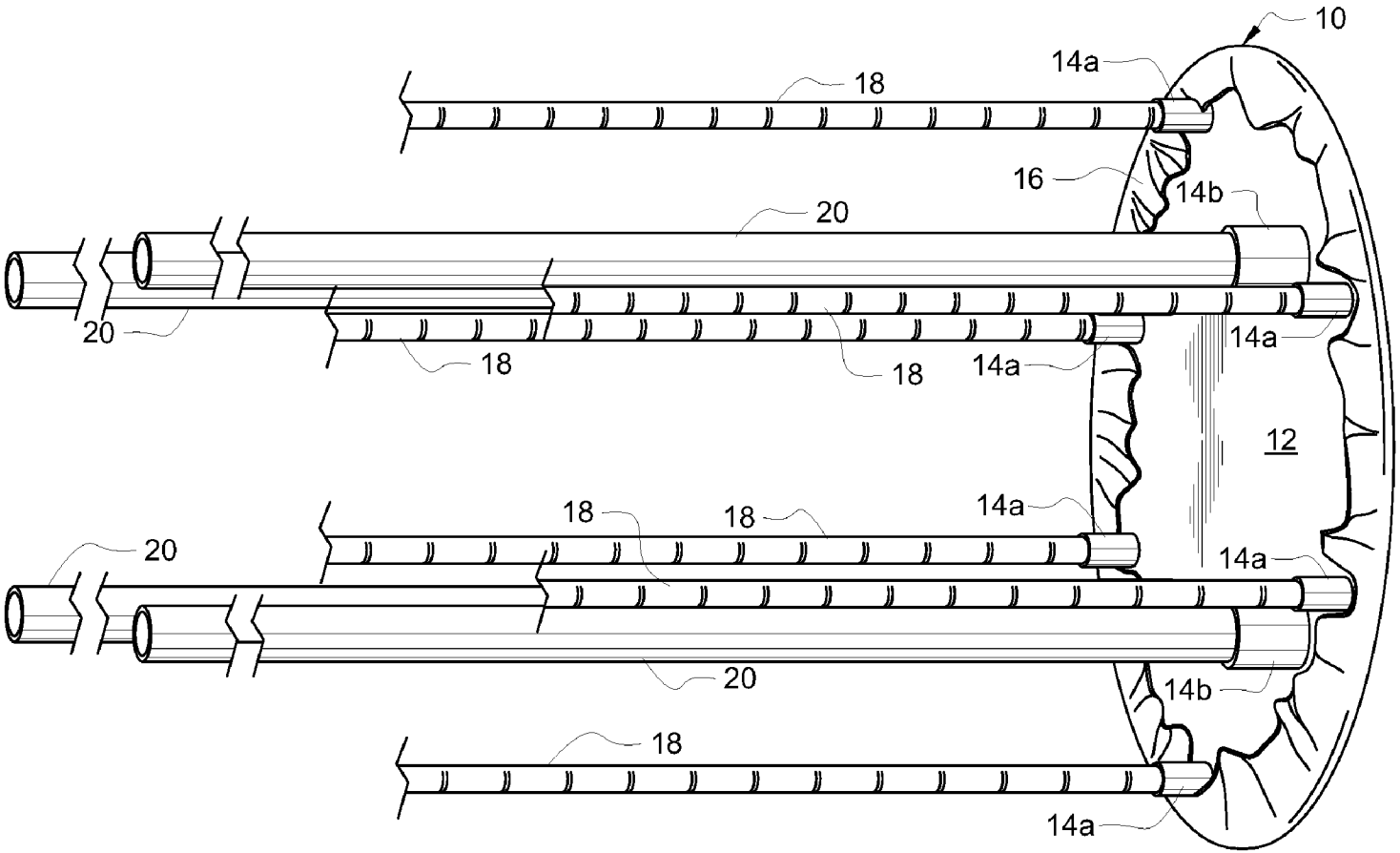
FIG. 2B is a perspective view depicting the connecting of fluid tubes.

FIG. 2B depicts the connection of the respective free ends of fluid lines or tubes, collectively denoted 20, to their respective tubing connections 14*b*.

A good seal is not needed between the respective free ends of the rebars 18 and their connectors 14*a* nor is a good seal needed between the respective free ends of the fluid lines 20 and their connectors 14*b* at this stage of the assembly process. Pressure cell 10 and all of said tubing connectors will be entirely encased in concrete when the shaft is poured and said concrete will provide the seal.

Figure 3A:
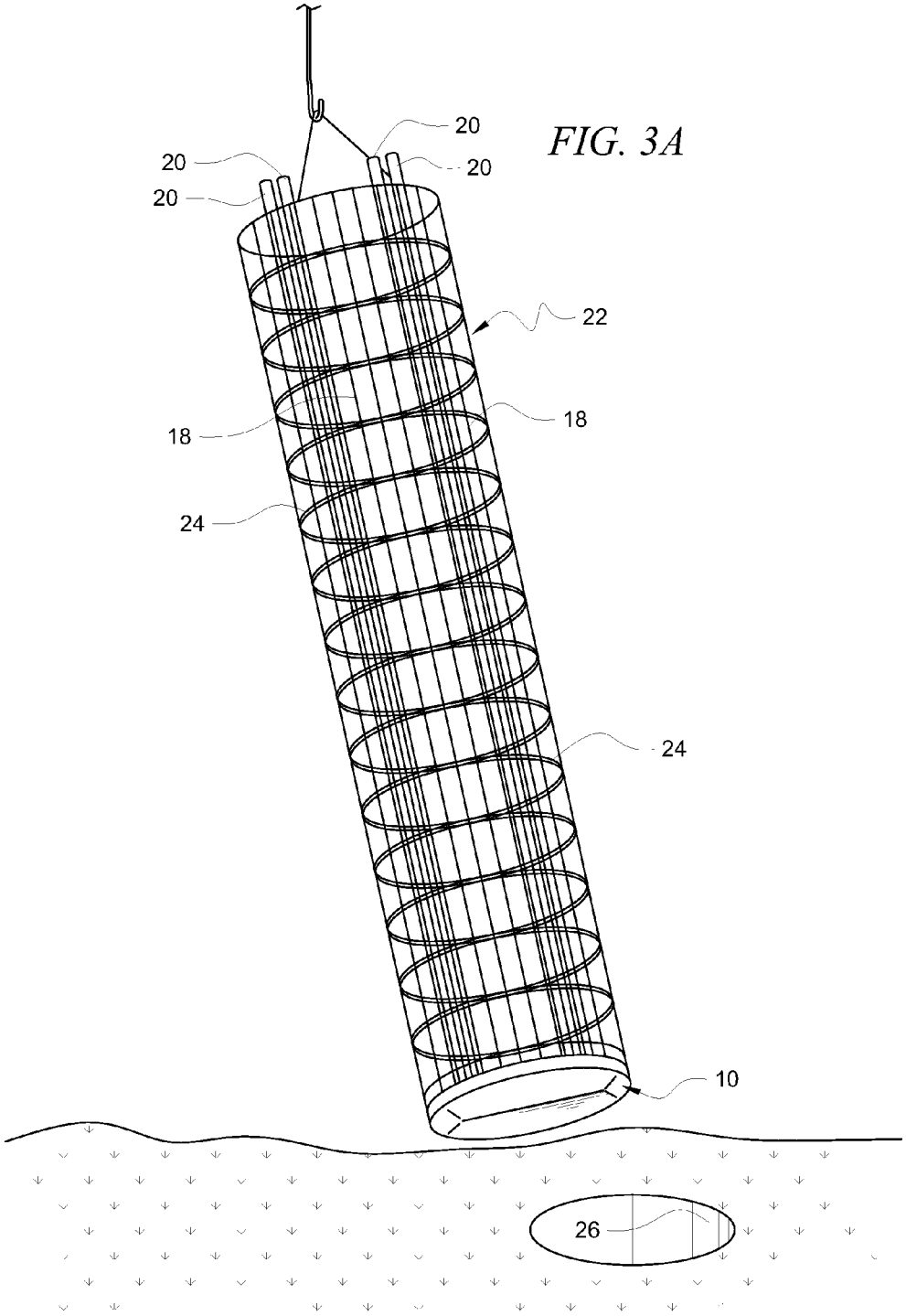
FIG. 3A is a perspective view of the pressure cell-equipped reinforcing cage being hoisted into a vertical position.

FIG. 3A depicts reinforcing cage 22 as a whole, with a hoisting procedure in progress. A plurality of equidistantly spaced apart annular bands 24 secure rebars 18 to one another. Normal drilled shaft construction can be carried out with pressure cell 10 already attached to reinforcing cage 22, or pressure cell 10 can be attached after said cage 22 has been hoisted into a vertical position.

Figure 3B:
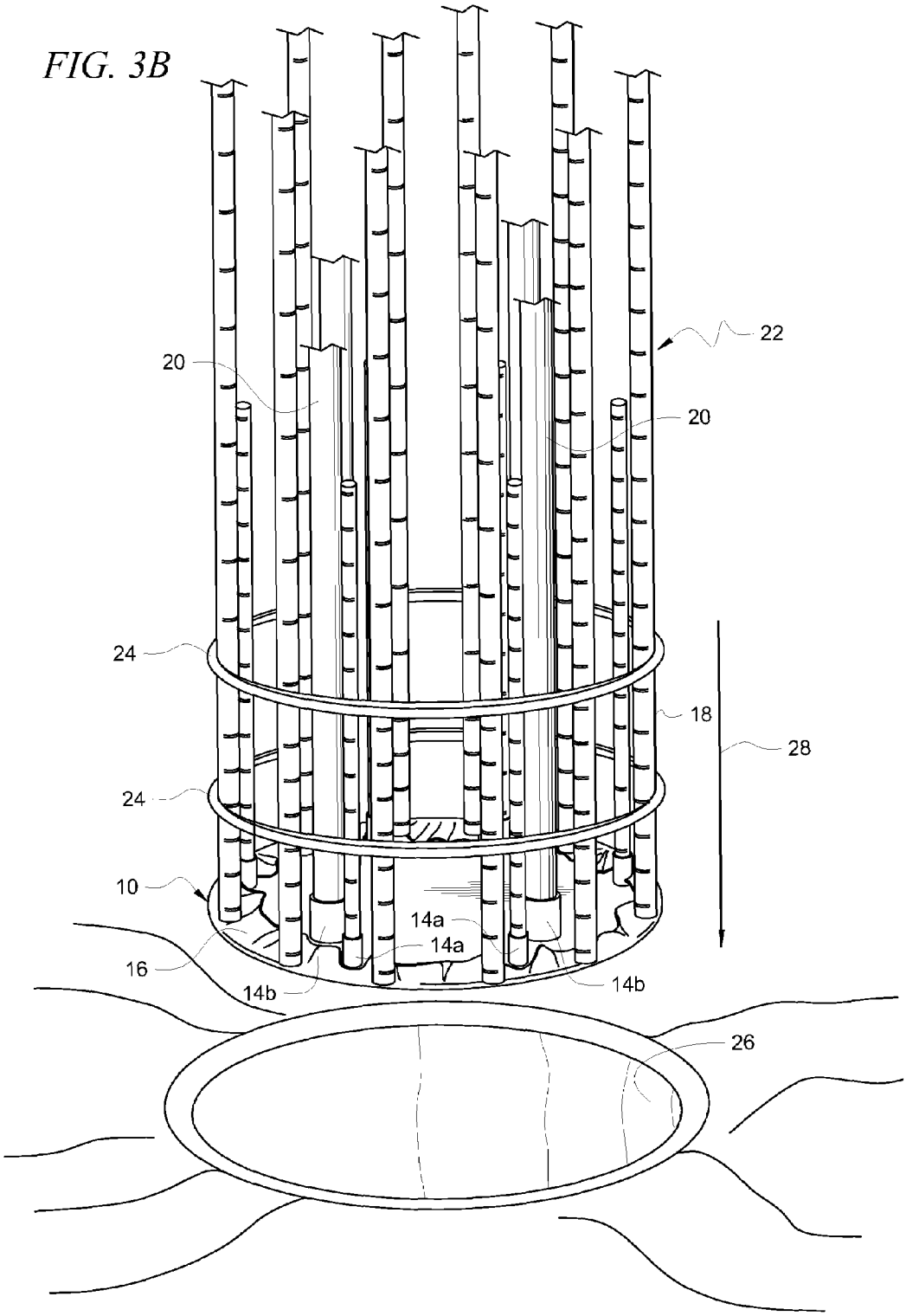
FIG. 3B is a perspective view of the pressure cell-equipped reinforcing cage placed in a cylindrical excavation.

FIG. 3B depicts reinforcing cage 22 in axial alignment with cylindrical excavation 26 for lowering thereinto as indicated by directional arrow 28.

Figure 4:
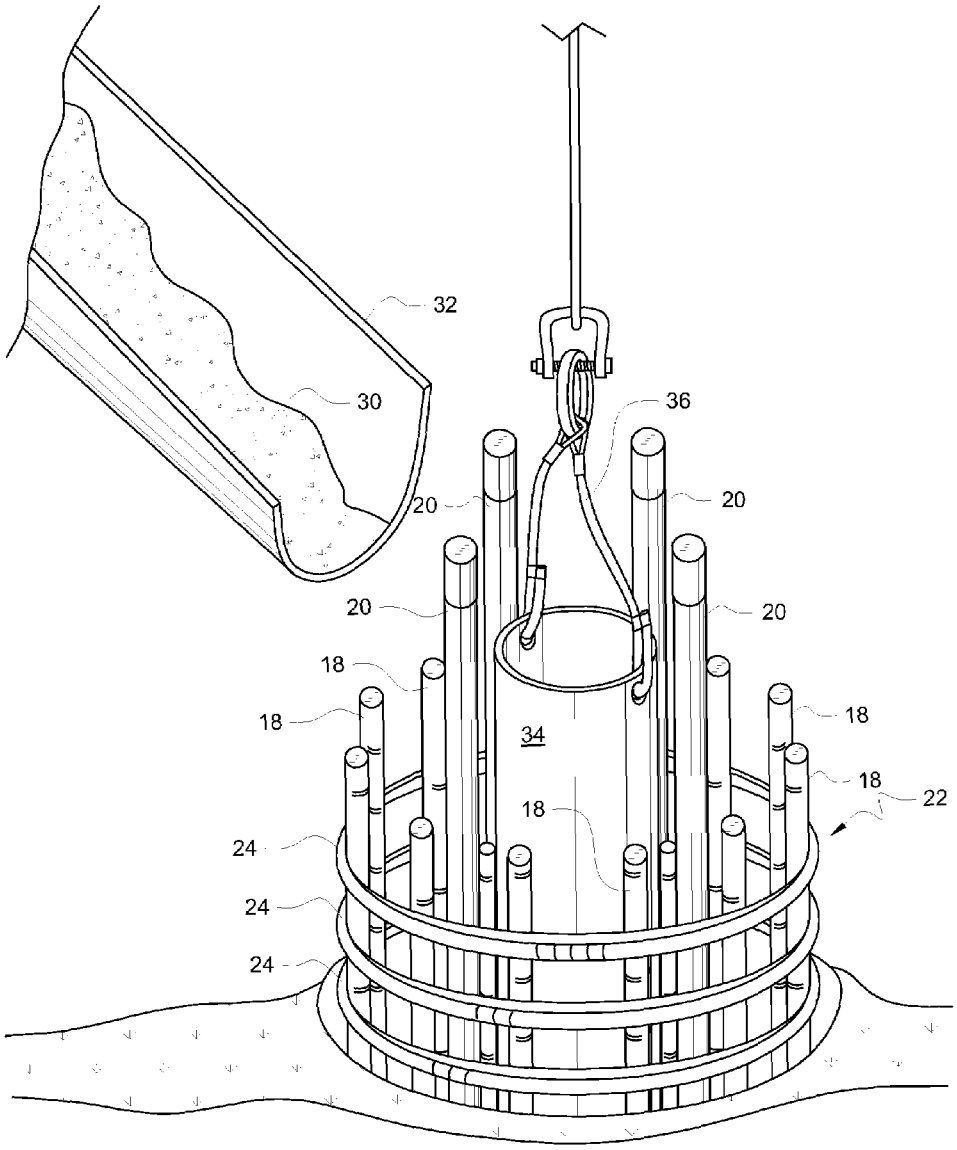
FIG. 4 is a perspective view depicting a conventional drilled shaft concreting procedure carried out with the novel pressure cell and pressure tube-equipped reinforcing cage in place.

Conventional drilled shaft construction practices are used to concrete the shaft as depicted in FIG. 4. More specifically, concrete 30 is delivered by chute 32 into the hollow interior of pipe 34 which is suspended by straps 36 in substantially concentric alignment with annular bands 24 of reinforcing cage 22.

Figure 5:
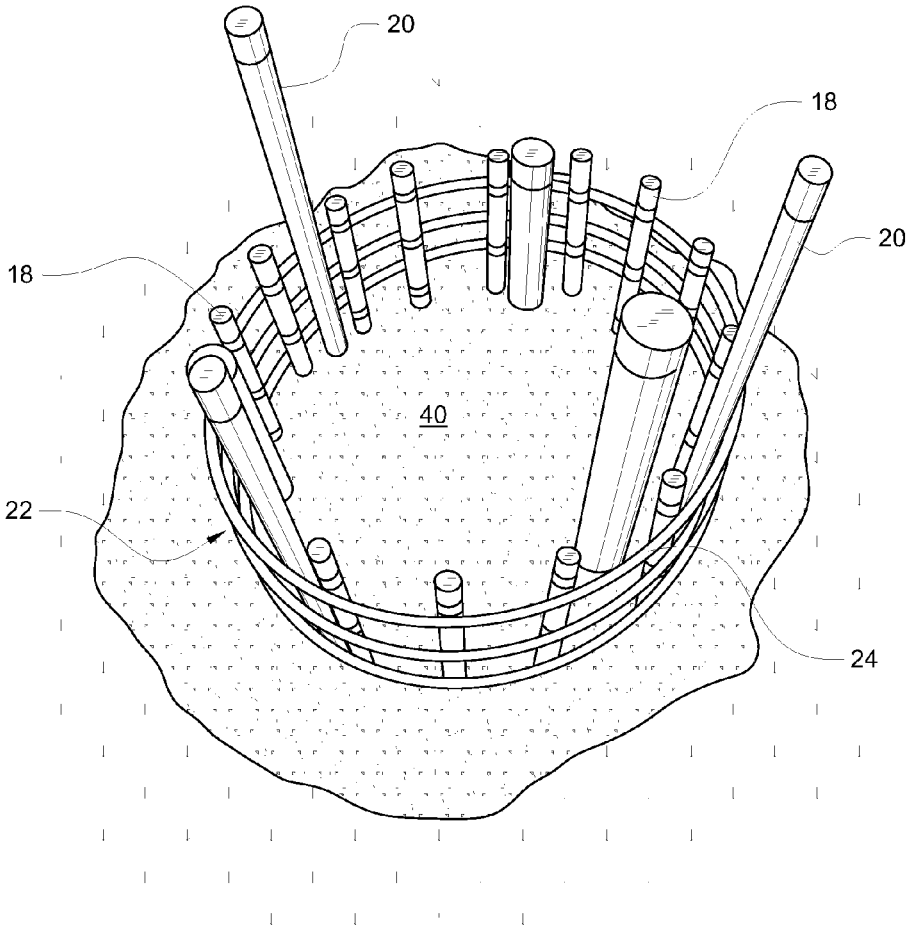
FIG. 5 is a perspective view of a finished shaft ready to have the end bearing enhanced.
Figure 6:
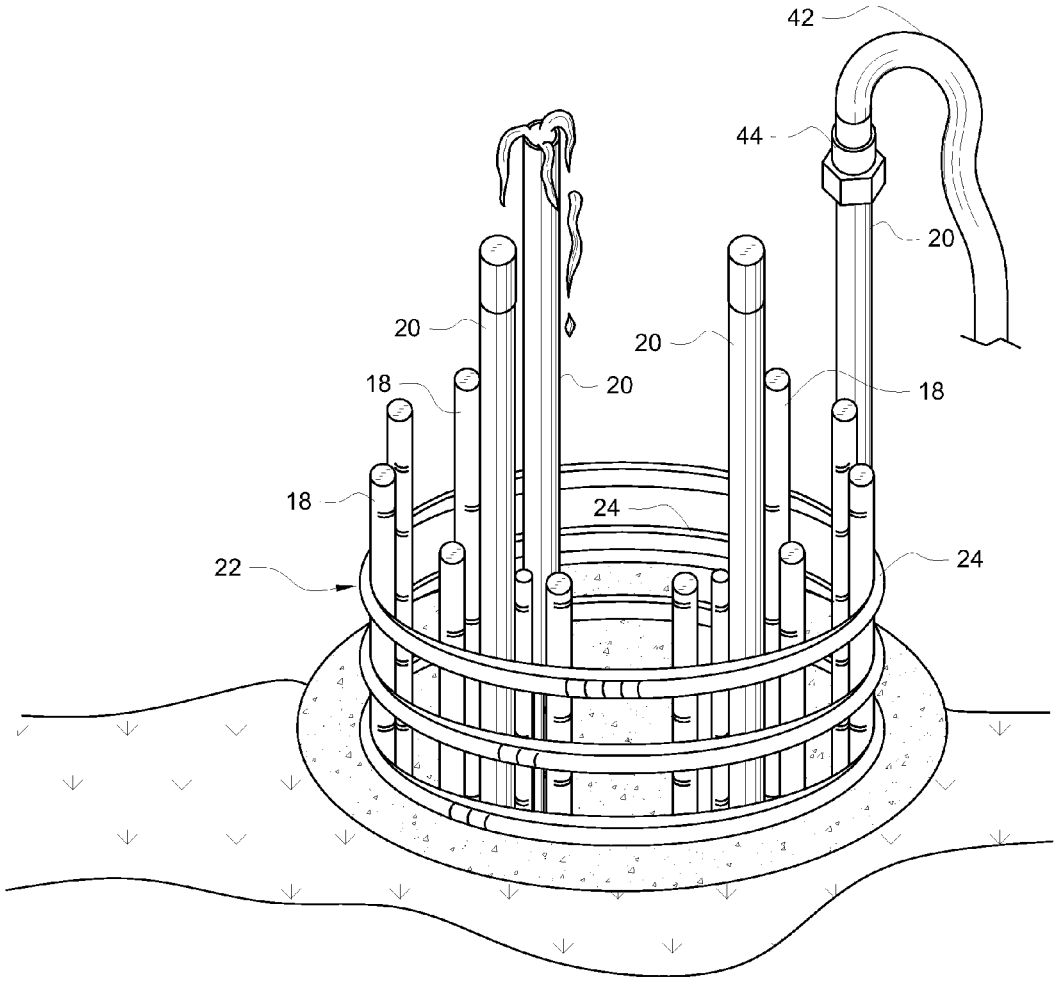
FIG. 6 is a perspective view depicting the flushing of pressure lines with water prior to pressurizing.

A short length of reinforcing cage 22 and pressure tubes 20 extend above finished concrete level 40 as depicted in FIG. 5. As depicted in FIG. 6, this provides access to said pressure tubes 20 so that pressure hose 42 from a pump, not illustrated, may be connected to an uppermost end of a pressure tube 20 as at 44. Return flow 46 as depicted in FIG. 6 indicates good communication across the bottom of the shaft.

Pre-compressing the end bearing strata can commence after the shaft concrete has developed adequate strength. As the design pre-compression pressure is generally far less than the concrete breaking stress, this operation is typically performed several days after pouring the concrete. The end bearing enhancement procedure involves several steps: 1) Flushing the pressure lines with water or the pre-compression fluid, as indicated in FIG. 6; 2) Capping off all secondary lines not connected to the pressure pump; 3) Slowly applying pressure to the base of the shaft until the a predetermined design pressure is achieved; 4) Releasing the fluid pressure; 5) Uncapping the out-flowing fluid line; and 6) Replacing the pre-compression fluid with a hardening grout.

Pre-compressing the end bearing strata should be performed while monitoring various performance indicators. These include pre-compression fluid pressure (the desired target parameter), uplift movement, and volume of fluid used to affect a given pressure. When plotted in real time, the effectiveness of the end bearing enhancement program can be ascertained.

Figure 7A:
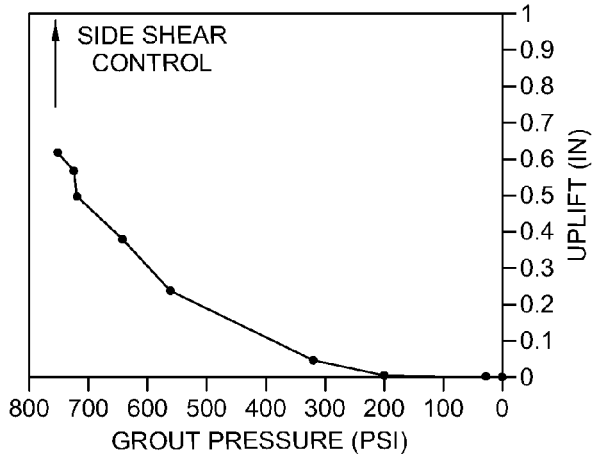
FIG. 7A is a graphical depiction of grout pressure in psi versus side shear control.
Figure 7B:
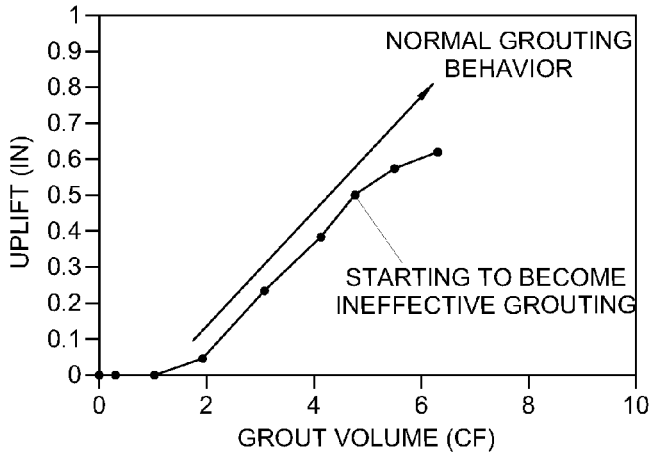
FIG. 7B is a graphical depiction of uplift in inches versus grout volume.
Figure 7C:
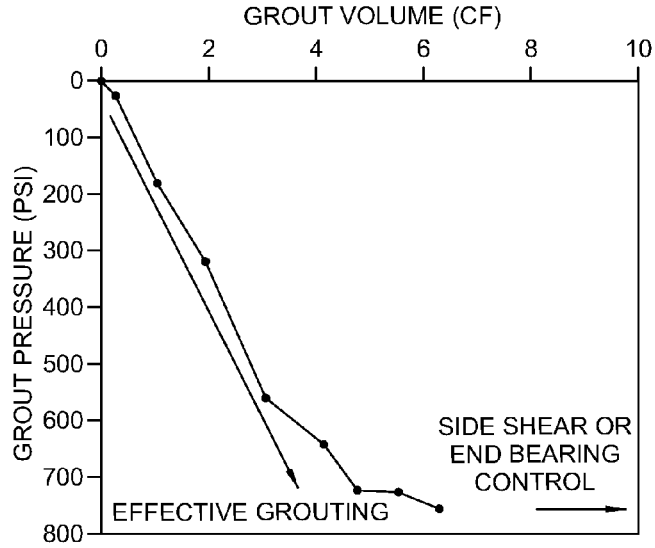
FIG. 7C is a graphical depiction of grout pressure in psi versus side shear or end bearing control.

FIGS. 7A, 7B, and 7C graphically depict the results of a normal, side shear controlled end bearing enhancement program wherein a pre-compression force that simultaneously pushes down on the soil while pushing up on the shaft begins to overcome the available side shear and uplift ensues. This program used grout as the pre-compression fluid.

Upon satisfactorily pre-compressing the end bearing strata, the fluid pressure should be slowly released and the outflow lines uncapped. If a non-hardening fluid was used to affect end bearing enhancement, a hardening grout is then pumped through the in-flowing line, which flows throughout and fills the void created by the pre-compression fluid, and back up the out-flowing line or lines.

When all return lines demonstrate that good consistency grout has returned, the pumping line is removed and all lines are left open to cure without external or additional pressure.

The term "grout" as used herein could be changed to "pre-compression fluid" of which grout is one option provided it never cures under additional external pressure. This change would not apply to those areas concerning prior art where grout was the only conceived fluid or where the precompression fluid is exchanged with grout.

Now that the invention has been described,

What is claimed is:

1. A method for increasing stiffness of bearing strata formed of soil, rock or other geomaterial, comprising the steps of:

forming a shaft in said soil, rock, or other geomaterial with a drill bit, said shaft having a foundation tip;

compressing soil, rock, or other geomaterial beneath the foundation tip of the shaft;

compressing said soil, rock, or other geomaterial by forming a void in said soil, rock, or other geomaterial beneath said foundation tip of said shaft by injecting non-hardening pre-compression fluids into said bearing strata formed of said soil, rock, or other goematerial to cause pre-compression of said soil, rock, or other geomaterial beneath said foundation tip of said shaft;

said non-hardening pre-compression fluids creating said void beneath said foundation tip of said shaft by squeezing water from voids in said soil, rock, or other geomaterial;

filling said void with said non-hardening pre-compression fluids and maintaining said non-hardening pre-compression fluids in said void for a length of time sufficient to allow water to be squeezed from said soil, rock, or other geomaterial beneath said foundation tip of said shaft;

removing said non-hardening pre-compression fluids from said void;

filling said void with cement grout; and curing said cement grout in the substantial absence of additional pressure;

whereby end bearing capacity is improved at least ten times greater than the bearing capacity of an unimproved foundation.

2. The method of claim 1, further comprising the step of:

injecting said non-hardening pre-compression fluids in the form of non-hardening slurries that are pressurized beneath said foundation tip of said shaft.

3. The method of claim 1, further comprising the step of also employing mechanical means to precompress said soil, rock, or other geomaterial.

4. A method for end-bearing enhancement, comprising the steps of:

drilling a shaft;

providing a rebar cage that fits within said shaft;

positioning a pressure plate at a lowermost end of said rebar cage;

providing a plurality of rebar connectors about a periphery of said pressure plate and connecting respective lowermost ends of said rebars to said connectors;

providing a plurality of fluid-carrying tubes, providing a plurality of tube connectors about a periphery of said pressure plate and connecting respective lower ends of said fluid-carrying tubes to said tube connectors;

dimensioning each fluid-carrying tube to have a length that exceeds a depth of said shaft so that respective uppermost ends of said fluid-carrying tubes project above ground level when respective lowermost ends of said fluid-carrying tubes are connected to said tube connectors;

said tube connectors including openings formed in said pressure plate so that fluid pumped into said fluid tubes compresses bearing strata below said pressure plate;

flushing said fluid-carrying tubes with a liquid fluid;

pre-compressing end bearing strata below said pressure plate by introducing non-hardening liquid fluid into uppermost ends of said fluid-carrying tubes and slowly applying fluid pressure until a predetermined design pressure is achieved in a void formed below said pressure plate by said non-hardening liquid fluid;

releasing the applied fluid pressure when said predetermined design pressure is achieved;

uncapping a fluid tube so that said non-hardening liquid fluid may flow upwardly from said void and out of an uppermost end of said uncapped fluid tube; and replacing the liquid fluid with grout.

5. The method of claim 4, wherein the step of flushing the fluid-carrying tubes with a liquid fluid includes the step of flushing the fluid-carrying tubes with water.

6. The method of claim 4, wherein the step of flushing the fluid-carrying tubes with a liquid fluid includes the step of flushing the fluid-carrying tubes with a pre-compression fluid.

7. The method of claim 4, further comprising the steps of:

monitoring grout pressure during the step of replacing the liquid fluid with grout; and plotting said grout pressure in real time as an aid in determining the effectiveness of the end-bearing enhancement method.

8. The method of claim 4, further comprising the steps of:

monitoring uplift movement during the step of pre-compressing the end bearing strata; and plotting said uplift movement in real time as an aid in determining the effectiveness of the end-bearing enhancement method.

9. The method of claim 4, further comprising the steps of:

monitoring the volume of fluid used to affect a predetermined pressure during the step of pre-compressing the end bearing strata; and plotting said volume of fluid used to affect a predetermined pressure in real time as an aid in determining the effectiveness of the end-bearing enhancement method.

* * * * *